United States Patent [19]

Burger et al.

[11] Patent Number: 4,652,212

[45] Date of Patent: Mar. 24, 1987

[54] ROTOR FOR A GAS TURBINE

[75] Inventors: Helmut Burger, Wailbingen-Hegnach; Siegfried Sumser, Stuttgart, both of Fed. Rep. of Germany

[73] Assignee: Daimler-Benz Aktiengesellschaft, Fed. Rep. of Germany

[21] Appl. No.: 796,793

[22] Filed: Nov. 12, 1985

[30] Foreign Application Priority Data

Nov. 10, 1984 [DE] Fed. Rep. of Germany ..... 3441115

[51] Int. Cl.[4] ..... F01D 5/14

[52] U.S. Cl. ..... 416/188; 416/223 A; 416/DIG. 2

[58] Field of Search ..... 415/205, 213 R, 215; 416/179, 182, 186 R, 188, 185, 223 A, DIG. 2, 223 R

[56] References Cited

U.S. PATENT DOCUMENTS 2,965,287 12/1960 Schug ..... 416/188
2,985,952 5/1961 Nutter et al. ..... 416/DIG. 2 X
3,028,140 4/1962 Lage ..... 416/188
3,610,775 10/1971 Swearingen ..... 415/205 X
4,243,357 1/1981 Flynn et al. ..... 415/215
4,305,698 12/1981 Sumi ..... 416/188

FOREIGN PATENT DOCUMENTS 44-2243 1/1969 Japan ..... 416/188

*Primary Examiner*—Robert E. Garrett
*Assistant Examiner*—Joseph M. Pitko
*Attorney, Agent, or Firm*—Barnes & Thornburg

[57] ABSTRACT

A rotor for a gas turbine exhibits three-dimensionally curved blades which are curved counter to the direction of rotation of the rotor in the radial flow region. The blades are arranged on a hub with a disc-shaped terminal region. In order to achieve a more highly aerodynamic blade shape with a simultaneous reduction of the moment of inertia of the rotor, the blades exhibit in the axial direction mean camber lines which extend centrally in the radial direction between the pressure side and the suction side of the blades, the mean camber lines being describable by a 2nd order curve equation.

7 Claims, 10 Drawing Figures

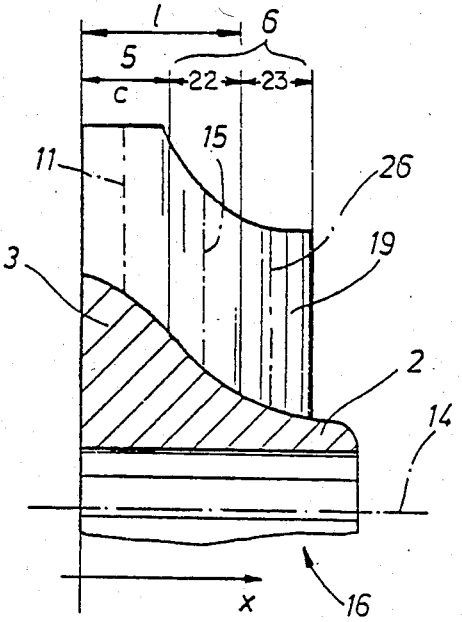
Fig. 3
Fig. 4
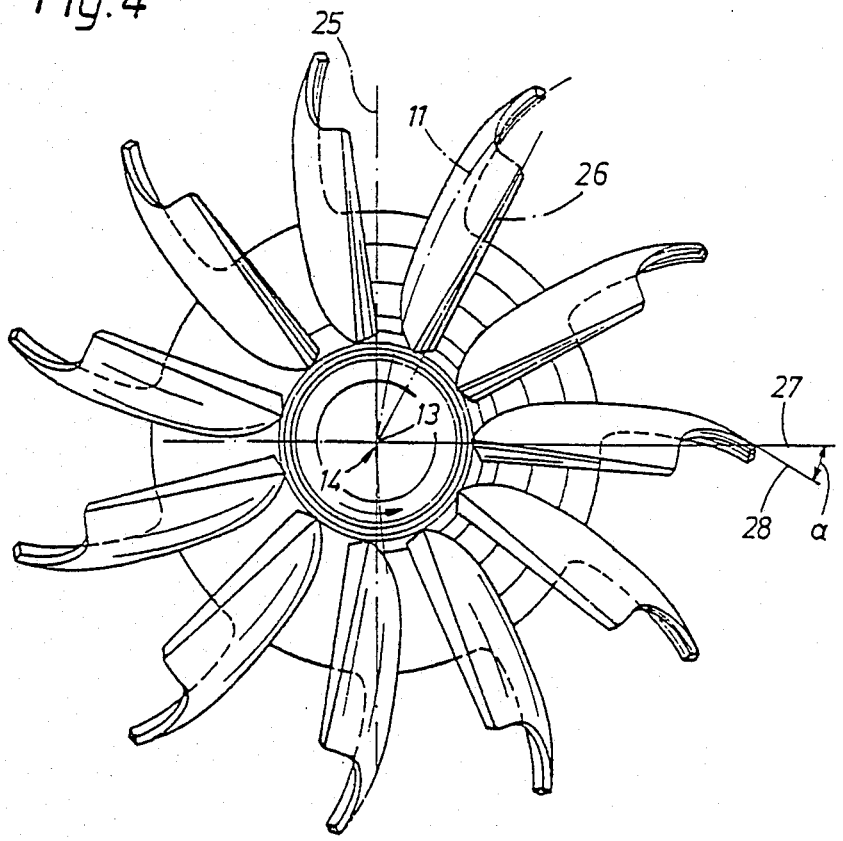

ROTOR FOR A GAS TURBINE

BACKGROUND OF THE INVENTION

This invention relates to a rotor for a gas turbine with a hub and three dimensionally curved blades which are curved counter to the direction of rotation of the rotor in the radial flow region.

A radial turbine with a rotor comprised of three dimensionally curved blades exhibiting a wing profile and curved counter to the direction of rotation is shown in U.S. Pat. No. 4,243,357 to Flynn et al. The rotor also includes a hub with a disc-shaped terminal region, which the blades touch at their radial flow region.

A gas turbine is also shown in U.S. Pat. No. 4,381,172 to Yu, having three dimensionally curved blades which are curved counter to the direction of rotation in the radial flow region. However, the above references do not disclose equations which describe the curvature of the blades.

It is an object of the present invention, in a radial turbine of the type referred to, to construct the blades so that a gas stream, even a small one, can be passed virtually free from impact, from the pressure side to the suction side of the blades. A further object is to obtain a desired velocity pattern of the gas stream flowing around the blades over each cross-section of the blades by predetermining the curvature of the blades.

These and other objects are achieved according to the invention by providing a rotor of a gas turbine with three dimensionally curved blades which exhibit mean camber lines extending radially from the axis of rotation that are describable by a second order curve equation.

By configuring the blades of a rotor in accordance with the present invention, the gas turbine exhibits improved efficiency in the lower speed range due to the reduction achieved in the angle of impact between the blades and gas stream flow. This produces both a greater unloaded rate of acceleration and also an increase of the effective gas turbine power, whereby greater acceleration power is available for an increase in speed during the running-up phase.

Further objects, features, and advantages of the present invention will become more apparent from the following description when taken with the accompanying drawings, which show for purposes of illustration only, an embodiment constructed in accordance with the present invention.

BRIEF DESCRIPTION OF THE DRAWINGS

FIG. 3 is a partial sectional view through a rotor constructed in accordance with another preferred embodiment of the present invention;

FIG. 4 is a view along the axis of rotation of the embodiment of FIG. 3;

DETAILED DESCRIPTION OF THE DRAWINGS

Figure 1:
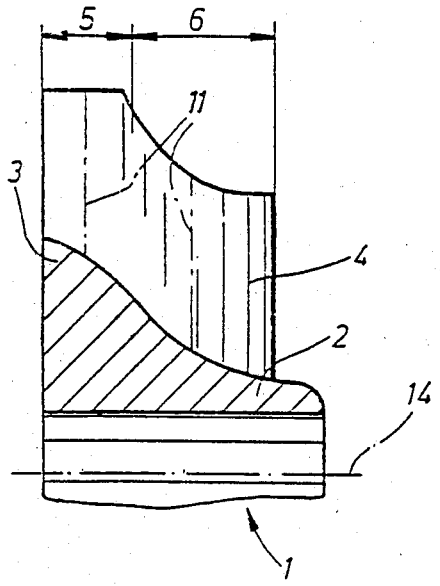
FIG. 1 is a partial sectional view through a rotor constructed in accordance with the present invention.

A rotor 1 constructed in accordance with a preferred embodiment as shown in FIG. 1, comprises a hub 2 with a disc-shaped terminal region 3. Three dimensionally curved semi-axial blades 4, which are arranged on the hub 2, have an outer radial flow region 5 limited by the disc-shaped terminal region 3 of the hub 2 on one side and by the semi-axially curved region 6 of the blades 4 on the other side.

Figure 2:
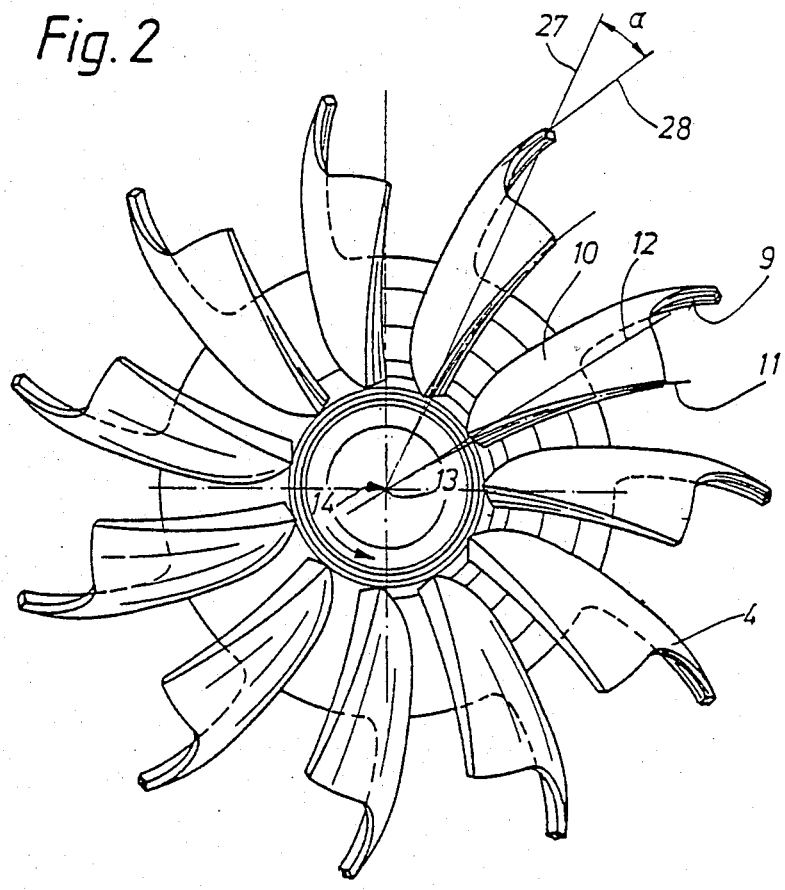
FIG. 2 is a view along the axis of rotation of the embodiment of FIG. 1.
Figure 5:
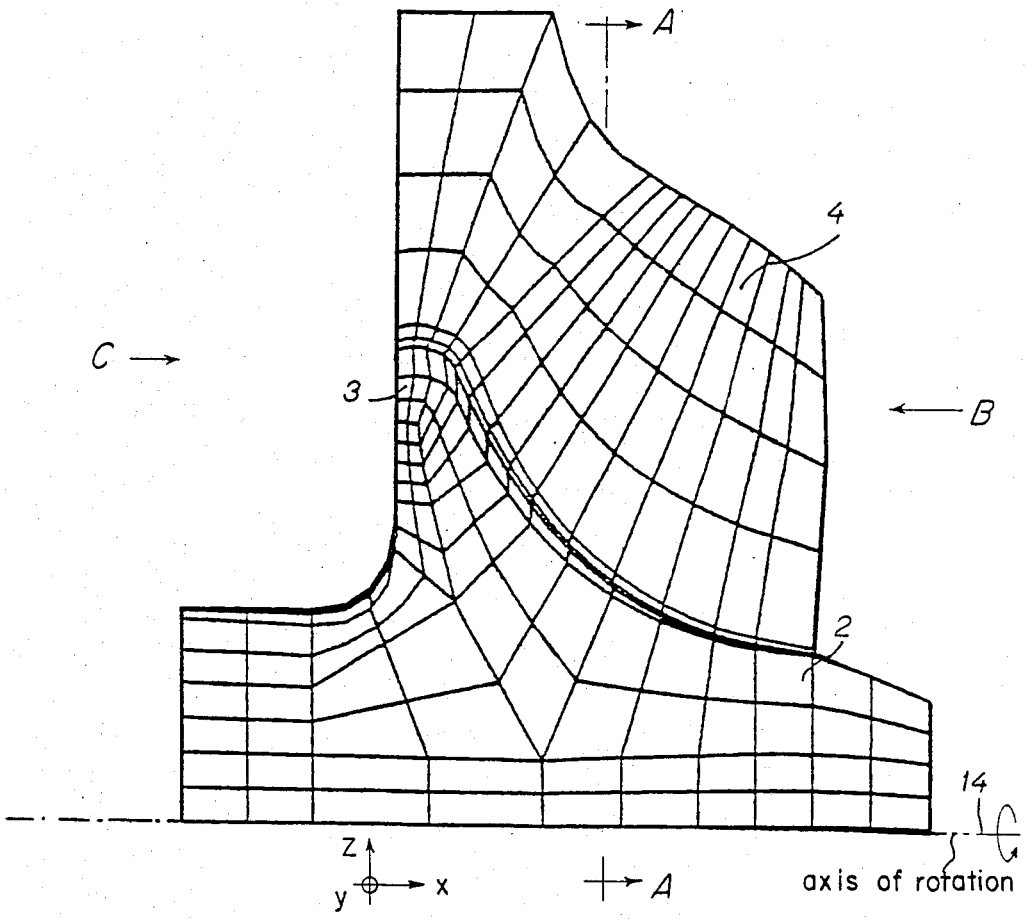
FIG. 5 is a three dimensional schematic partial sectional view through the rotor of FIGS. 1 and 2.

The embodiment of the rotor 1 shown in FIG. 1 is shown in a view along the axis of rotation in FIG. 2. The three dimensionally curved blades 4 exhibit, along their axial extension, mean camber lines 11 extending centrally in the radial direction between a pressure side 9 and a suction side 10 of the blades 4. The mean camber lines 11 are describable by a second order curve equation, namely an ellipse as discussed in more detail below. The mean camber lines 11 extend at right angles to the axis of rotation 14 and produce, with respective tangents 12 touching them, respective contact points 13 which lie on the axis of rotation 14 of the rotor 1.

The blades 4 are curved in the outer radial flow region 5 such that the gas stream incident thereto is passed virtually impact-free from the pressure side 9 to the suction side 10. The angle of curvature $\alpha$ formed at the blade entry is determined by a radius 27 intersecting the axis of rotation 14 and the mean camber line 11 in the outer radial flow region 5, and by a tangent 28 touching the suction side 10 in the outer radial flow region 5. The angle of curvature $\alpha$ preferably has a value between 5° and 45°.

A rotor 16 constructed in accordance with another preferred embodiment of the present invention is shown in FIG. 3 and comprises a hub 2 with a disc-shaped terminal region 3. Blades 19, which are arranged on the hub 2, exhibit an outer radial flow region 5 and a semi-axial flow region 6. The outer radial flow region 5 exhibits, along its axial extension, mean camber lines 11 describable by a second order curve equation. The semi-axial flow region 6 is subdivided into a transition region 22 and an axial flow region 23.

According to the embodiment shown in FIG. 4, the blades 19 are curved three dimensionally and in a radial direction counter to the direction of rotation in the outer radial flow region 5. A mean camber line 11 perpendicular to the axis of rotation 14 and a tangent 25 associted with the mean camber line produce a contact point 13 which lies on the axis of rotation 14 of the rotor 16. The mean camber line 11 is describable by a second order curve equation, which in a preferred embodiment, is an ellipse. The transition region 22 exhibits mean camber lines 15 which are describable by a 2nd order curve equation, the curvature of which becomes steadily smaller in the escape direction, so that they form straight lines 26 in the axial flow region 23.

The axial flow region 23 adjacent to the transition region 22 and having radially oriented blades exhibits mean camber lines 26 which are formed by radially oriented straight lines 26 which lead through the axis of rotation 14.

FIGS. 5–10 schematically depict the embodiment of FIGS. 1 and 2. The grid lines are included to assist in depicting the three dimensional configuration of the present invention.

Figure 6:
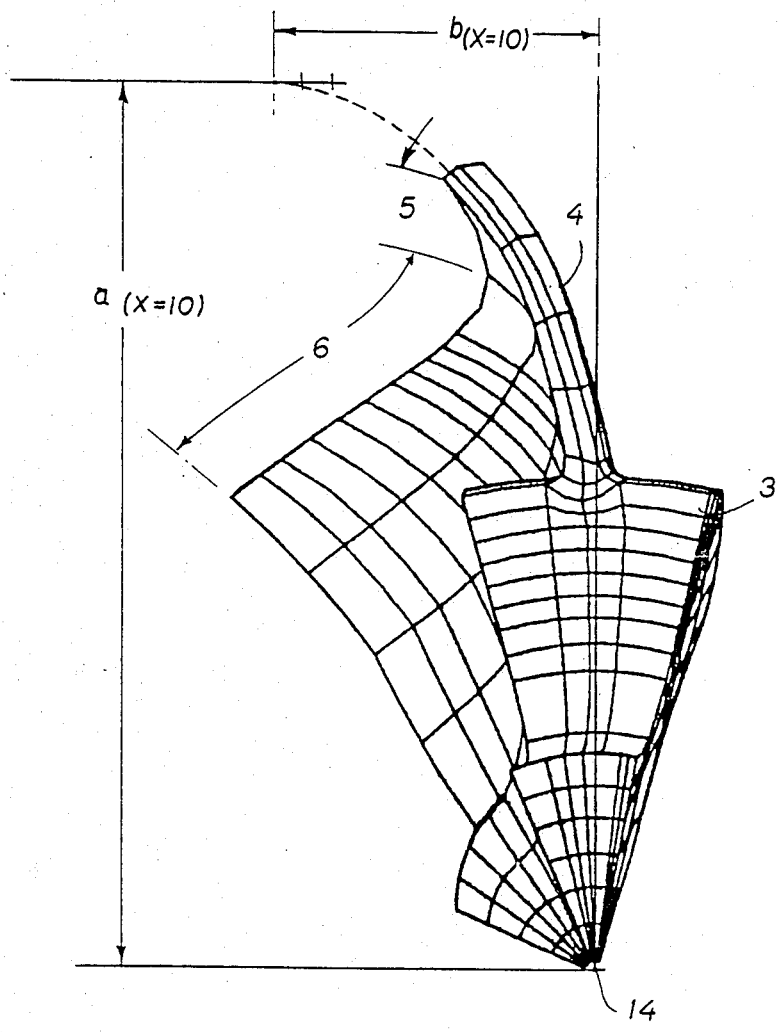
FIG. 6 is a three dimensional schematic view along the axis of rotation in the direction C of FIG. 5.

FIG. 6 shows the mean camber line 11 through a blade 4 as a dashed line. As can be seen from FIG. 5, the mean camber line 11 is a portion of an ellipse. The ellipse illustrated in this figure lies in the y-z plane at x=0. The ellipse has a major semi-axis $a_o$ and a minor semi-axis b.

Figure 7:
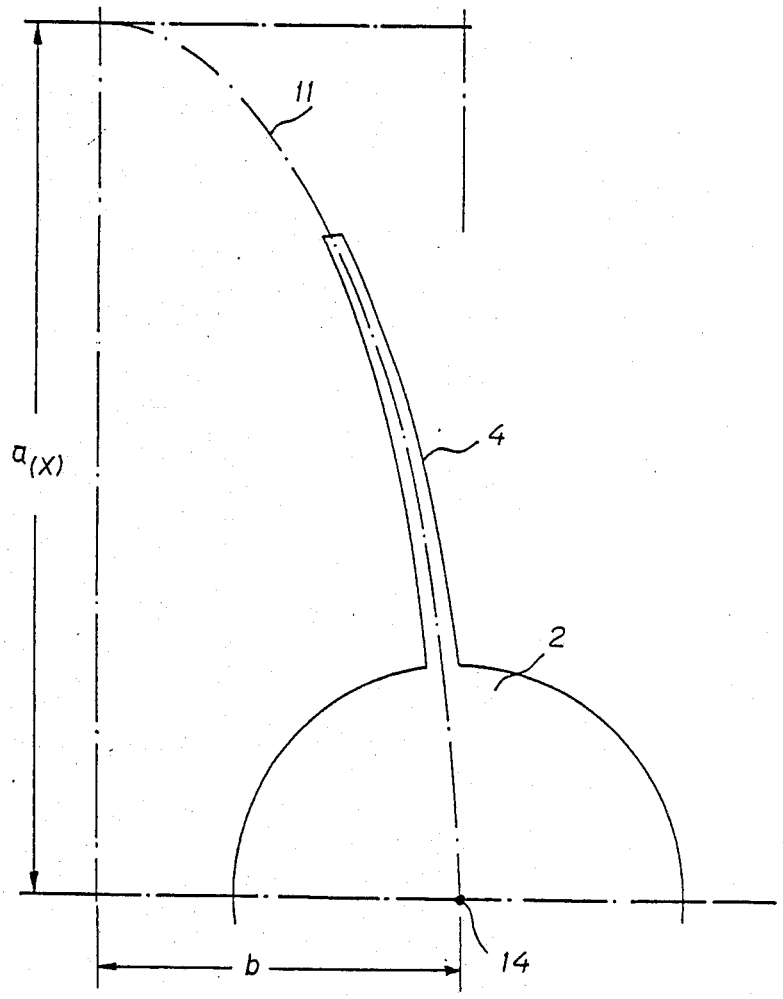
FIG. 7 is a cross-sectional schematic view taken along line A—A of FIG. 5.

FIG. 7 shows the elliptic curve at another point along the x-axis. The minor semi-axis of the ellipse remains constant, while the length of the major semi-axis in the y direction varies along the x-axis toward the axial flow region 23. Thus, the shape of the ellipse changes in each y-z plane for each value of x along the x-axis, thereby creating a three dimensionally curved shape. Since b remains constant, the shape of the ellipse, and thus, the curvature of the blades, is dependent only on the change in the major semi-axis (a(x)), which is described as a function of the position along the x-axis by the following expression:

$$a_x = a_o + \frac{(x-c)^n}{\left(1 - \frac{x-c}{1-c}\right)^m}$$

wherein:

$a_{(x)}$ is the local major semi-axis, $a_0$ the major semi-axis in the radial approach region, x is the axial extension of the blades with the origin in the disc-shaped terminal region of the hub, c is the blade width of the outer radial flow region, l is the blade width of the outer radial flow region and of the transition region, n is the exponent of the dividend, and m is the exponent of the divisor.

In a preferred embodiment the values of m and n are between and include zero and 2.5. An especially preferred embodiment fixes the values of m and n between 0.5 and 1.5.

Figure 8:
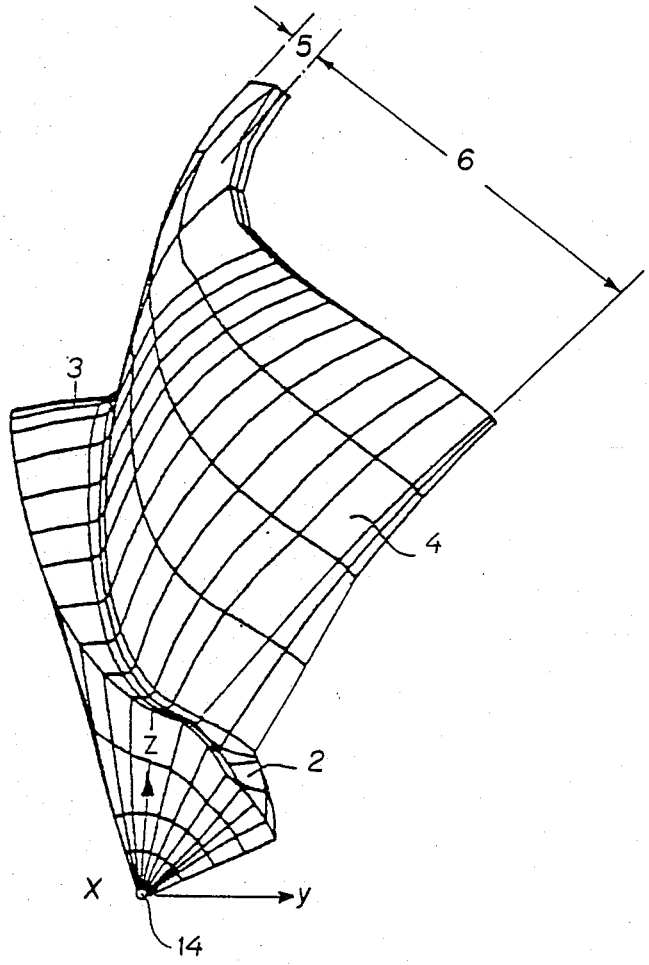
FIG. 8 is a three dimensional schematic view along the axis of rotation in the direction B of FIG. 5.
Figure 9:
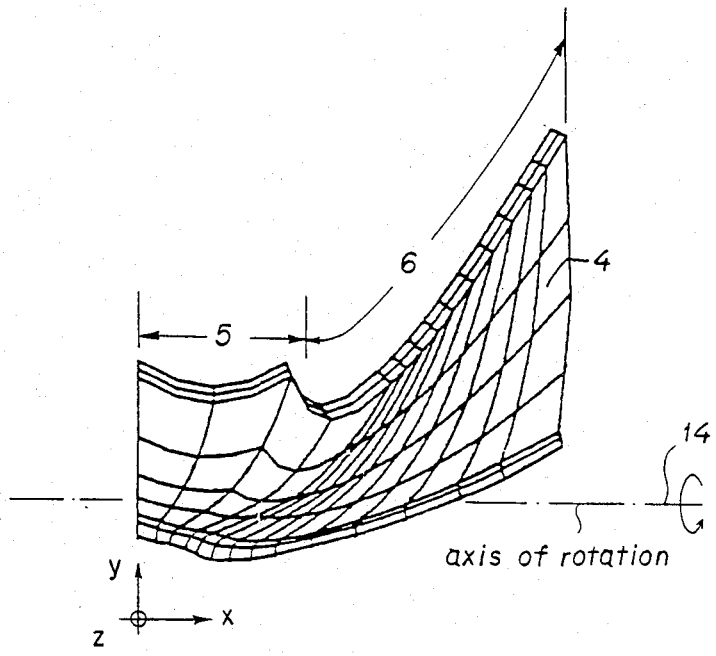
FIG. 9 is a three dimensional schematic view of a single one of the blades of the rotor of FIGS. 1 and 2.
Figure 10:
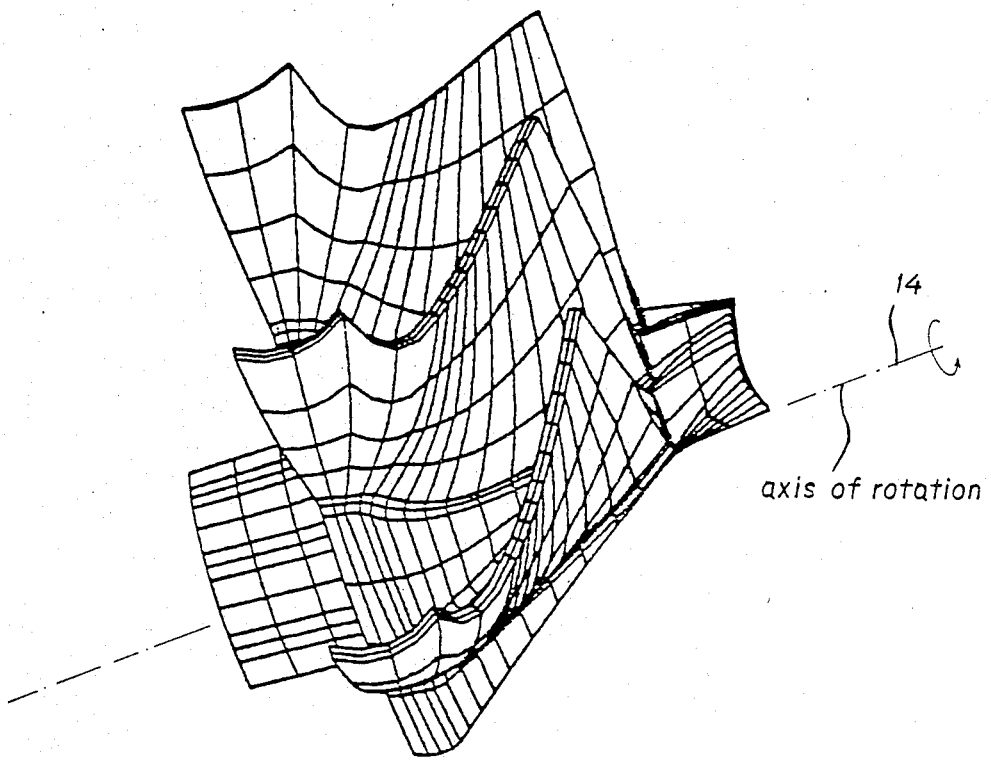
FIG. 10 is a three dimensional schematic perspective view of the rotor of FIGS. 1 and 2.

FIGS. 8–10 show various three dimensional views of a blade 4 mounted to the terminal region 3; a blade 4 in isolation; and a plurality of blades 4 mounted to the hub 2, respectively.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. A gas turbine rotor having blades arranged on a hub with radial and semi-axial flow blade regions, of which the semi-axial flow blade region has a first blade section starting at a blade edge, said first blade section having straight camber lines and which radially projects from the hub, and of which the radial flow blade region has camber lines extending sloped with respect to the hub against the rotating direction of the rotor, wherein the camber lines in the radial flow blade region have a bent course developed as an ellipse and are sloped with respect to the hub in such a way that a tangent placed against the camber line intersects the axis of rotation of the rotor, and wherein the elliptically bent camber lines of the radial flow blade region continue into a second blade section located in the semi-axial flow blade region which has camber lines that are also bent, the bending describable by a curve of the second order, and wherein the camber lines from the second blade section with a constantly decreasing bend change into the first blade section developed with the straight camber lines.

2. A rotor according to claim 1, wherein said camber lines of said second blade section are describable by the arithemetical expression:

$$a_x = a_o + \frac{(x-c)^n}{\left(1 - \frac{x-c}{1-c}\right)^m}$$

wherein:

$a_{(x)}$ is the local major semi-axis of an ellipse, $a_o$ the major semi-axis in the ellipse in the radial approach region, x is the axial extension of the blades with the origin in the disc-shaped terminal region of the hub, c is the blade width of the radial flow region, l is the blade width of the radial flow region and of the second blade section, n is the exponent of the dividend, and m is the exponent of the divisor.

3. A rotor according to claim 2, wherein said exponents m and n have a value between and including zero and 2.5.

4. A rotor according to claim 2, wherein said exponents m and n have a value between and including 0.5 and 1.5.

5. A rotor according to claim 2, wherein said radius of hub and fan blade is between 0 and 10 centimeters.

6. A rotor according to claim 1, wherein said blades include a suction-side 10; wherein said blades exhibit an angle of curvature at said radial flow blade region, said angle determined by a radius intersecting the axis of rotation of the rotor and said camber lines in said radial flow blade region, and by a line tangent to said suction side.

7. A rotor according to claim 6, wherein said angle of curvature is between 5° and 45°.

* * * * *